US005961820A

United States Patent [19]

Jeanblanc et al.

[11] Patent Number: 5,961,820

[45] Date of Patent: Oct. 5, 1999

[54] DESULFURIZATION PROCESS UTILIZING AN OXIDIZING AGENT, CARBONYL COMPOUND, AND HYDROXIDE

[75] Inventors: James K. Jeanblanc, Galva, Ill.; William E. Wismann, Oxnard, Calif.

[73] Assignee: DS2 Tech, Inc., Galva, Ill.

[21] Appl. No.: 09/085,478

[22] Filed: May 27, 1998

[51] Int. Cl.[6] ..... C10G 27/00; C10G 29/00; C10G 27/06; C10G 29/02

[52] U.S. Cl. ..... 208/231; 208/226; 208/240; 208/208 R; 208/196; 208/189; 208/203

[58] Field of Search ..... 208/189, 196, 208/203, 208 R, 226, 231, 240

[56] References Cited

U.S. PATENT DOCUMENTS 1,950,735 3/1934 Levine ..... 196/24

2,744,054 5/1956 Pieters et al. ..... 196/29

4,548,708 10/1985 Schwarzer et al. ..... 208/196

*Primary Examiner*—Walter D. Griffin

*Assistant Examiner*—Tam M Nguyen

*Attorney, Agent, or Firm*—Oppenheimer Wolff & Donnelly

[57] ABSTRACT

Sulfur-containing carbonaceous materials are desulfurized by reaction with a mixture of an oxidizing agent and a carbonyl compound under alkaline conditions at a temperature ranging from ambient temperature to about 250° F. and a pressure of about 1 atmosphere to 2 atmospheres. The products of the reaction are a desulfurized carbonaceous material in which the sulfur content is less than about 1%, and gaseous sulfur compounds. The carbonyl compound can be recovered and reused.

31 Claims, 1 Drawing Sheet

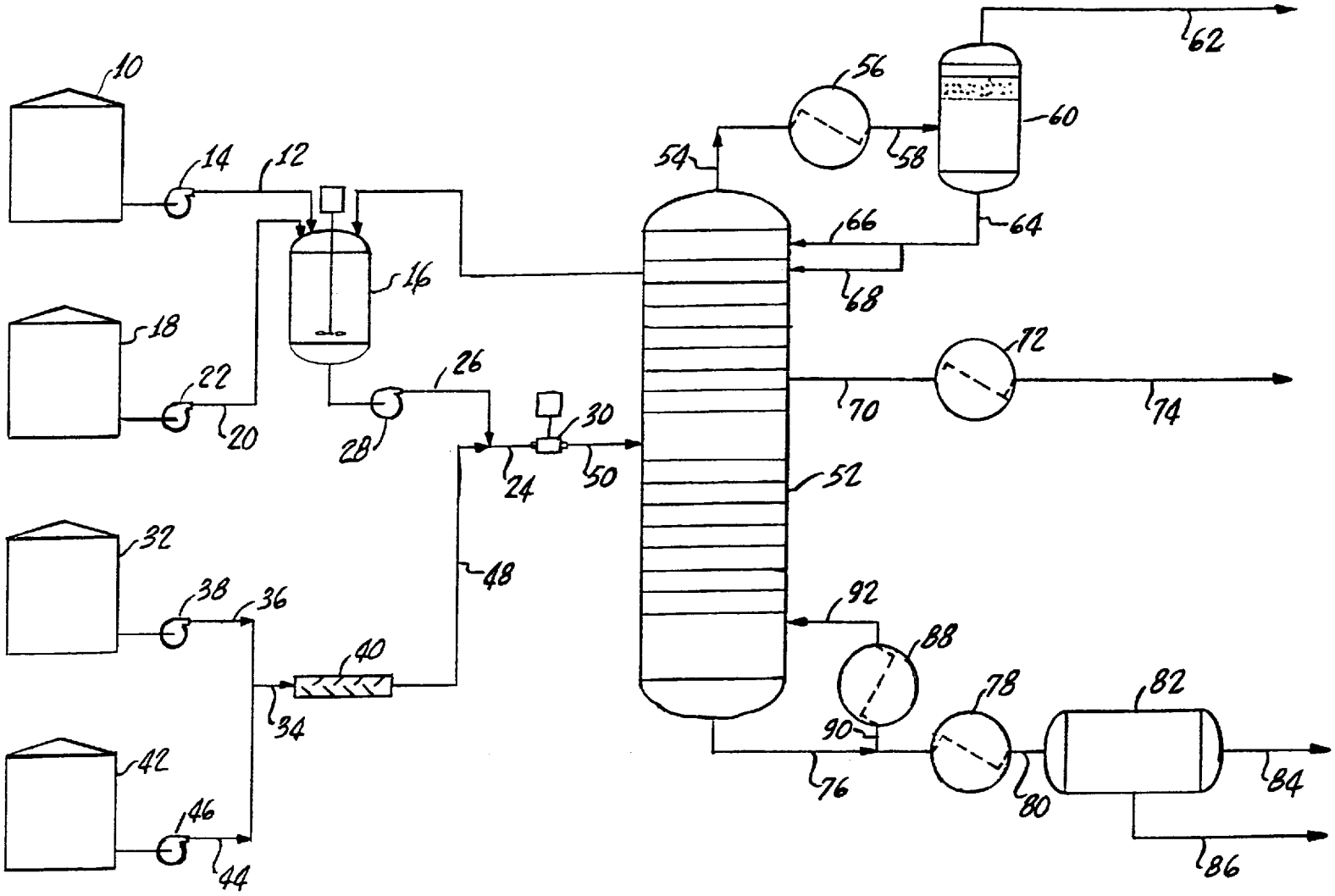
10
12
14
16
18
20
22
24
26
28
30
32
34
36
38
40
42
44
46
48
50
52
54
56
58
60
62
64
66
68
70
72
74
76
78
80
82
84
86
88
90
92

DESULFURIZATION PROCESS UTILIZING AN OXIDIZING AGENT, CARBONYL COMPOUND, AND HYDROXIDE

FIELD OF THE INVENTION

The present invention generally relates to the removal of sulfur from carbonaceous materials contaminated with sulfur in the form of sulfur-containing compounds. In one of its more particular aspects, this invention relates to a process for substantially reducing the sulfur content of coals. In another aspect this invention relates to a process for reducing the sulfur content of carbonaceous fluid such as petroleum fluids.

BACKGROUND OF THE INVENTION

Many carbonaceous materials may contain sulfur as a contaminant. Solid materials such as coals and waxes are known to contain varying amounts of sulfur. Some coals contain sulfur to such an extent that their use is contraindicated because of the polluting effect that burning such high-sulfur coals may have on the environment. The use of petroleum fluids such as oils and gasolines is also subject to restrictions based on their impact on the environment when they are used as fuels.

Petroleum crude oils, for example, such as topped or reduced crudes, as well as other heavy petroleum fractions and/or distillates, including vacuum tower bottoms, atmospheric tower bottoms, black oils, heavy cycle stocks, visbreaker product effluents, bitumens, and the like, are frequently contaminated by excessive concentrations of sulfur. Sulfur is also present in various processed hydrocarbons such as fuel oils and diesel fuels. The sulfur may be present in various combined forms including heteroaroinatic compounds. Removal of these combined forms of sulfur has proven difficult. The sulfur compounds are objectionable because combustion of fuels containing them as contaminants results in the release of sulfur oxides, which are noxious and corrosive, and presents a serious problem with respect to pollution of the atmosphere.

Various processes have been used in the past to remove objectionable sulfur-containing compounds from coal and petroleum. For example, sodium hydroxide or potassium hydroxide solutions have been used to treat petroleum fractions boiling in the general range below about 700° F. Extraction with a liquid solvent, such as sulfuric acid, sulfur dioxide, or furfural has also been used, as has adsorption on suitable materials, such as activated bauxite, charcoal, or clay. Mercaptans have been converted into disulfides and polysulfides by plumbite treatment or treatment with hypochlorite or copper salts. Many catalytic processes generally utilizing hydrogen under pressure have also been developed.

Each of the prior art methods is more or less satisfactory for removing a portion of the sulfur-containing, contaminants from carbonaceous materials. However, none has been devised which is effective to remove substantially all of the sulfur which is present as a contaminant.

It would be desirable to provide a process which is effective for removing sufficient sulfur from coals and petroleum fractions contaminated with sulfur-containing compounds to result in a product containing, for example, less than about 1% sulfur. Since petroleum fractions, such as heavy crudes, may contain as much as about 8–12% sulfur, such a process would represent removal of about 85–95% of the sulfur contaminant in such petroleum fractions.

It is accordingly an object of the present invention to provide a process which is effective to remove a substantial proportion of the sulfur which contaminates various carbonaceous materials.

It is another object of the present invention to provide such a process which utilizes readily available reactants.

Another object of this invention is to provide a process which can be operated at moderate temperatures and pressures.

A further object of the present invention is to provide a process for desulfurizing coals, petroleum products, and other sulfur-contaminated carbonaceous materials, which process is economical to operate and requires a minimum of specialized equipment.

Other objects and advantages of the present invention will become apparent during the course of the following detailed description and disclosure.

SUMMARY OF THE INVENTION

The present invention accomplishes the above-described and other objects by providing a process for removing sulfur from sulfur-containing compounds present in coals, petroleum fractions, and other sulfur-containing carbonaceous materials. In a broad aspect, the invention comprises treating a carbonaceous materials to be desulfurized with an oxidizing agent and a carbonyl compound under basic conditions. More particularly, the present invention provides a process for desulfurizing sulfur-containing carbonaceous materials, wherein sulfur is present in the form of sulfur-containing organic compounds, by reacting a sulfur-containing carbonaceous materials with a mixture of an oxidizing agent and a carbonyl compound under basic conditions to remove sulfur from such material.

In a typical process, coal or a petroleum fraction is mixed with hydrogen peroxide, acetone, and sodium hydroxide, at a temperature in the range of from ambient temperature to about 250° F. and a pressure in the range of from ambient pressure to 2 atmospheres. The resulting exothermic chemical reaction causes the temperature to rise and the reaction mixture to expand to about 5–15 times its original volume with the release of gaseous sulfur compounds. The principal products of the exothermic reaction are a desulfurized carbonaceous materials containing less than about 1% sulfur, sulfur-containing gases, and sulfur-containing salts, for example, hydrogen sulfide, sulfur dioxide, and carbonyl sulfide. The acetone or other carbonyl compound, which facilitates bond breaking to release the sulfur from sulfur-containing organic compounds, is recovered and can be reused in the process.

BRIEF DESCRIPTION OF THE DRAWING

The advantages and features of the present invention will be better understood by the following description when considered in conjunction with the accompanying drawing, in which the sole FIGURE is a schematic flow chart of a typical process in accordance with the present invention.

DETAILED DESCRIPTION

The present invention is directed to a process for desulfurizing carbonaceous materials which contain compounds in which sulfur is present.

The process provides a means for removing sulfur from coals, petroleum fractions, and other organic materials in which sulfur is present as various sulfur-containing organic compounds. Such compounds are difficult to desulfurize because desulfurization requires breaking various bonds including the relatively strong carbon-to-sulfur bond, C—S, as well as the weaker sulfur-to-sulfur, S—S, sulfur-to-oxygen, S—O, and sulfur-to-hydrogen, S—H, bonds.

Although the use of high pressures and temperatures to desulfurize various materials has proved successful to some extent in the past, the energy input using such means has required the use of specialized and expensive apparatus for this purpose. The present invention, rather than utilizing high pressures and temperatures for energy input, requires only low pressures and moderate temperatures and takes advantage of the energy produced by an exothermic chemical reaction between the carbonaceous material to be desulfurized, an oxidizing agent, and a carbonyl compound. The exothermic reaction takes place under basic conditions and requires little, if any, adjustment of the temperature and pressure; rather, the reaction, which occurs in the absence of a catalyst, proceeds under relatively mild conditions, including ambient or slightly elevated pressures and temperatures. In general, temperatures ranging from about ambient temperature to about 250° F. are used. Temperatures of about 120° F. to 250° F. are preferred. Pressures generally range from about 1 atmosphere to 2 atmospheres.

Any carbonyl compound can be used in the process of the present invention. However, in order to provide a convenient temperature range for operation of the process, it is preferred that the carbonyl compound be a relatively low boiling aldehyde or ketone in order to operate under mild conditions of temperature and pressure. Acetone, having a boiling point of 133.7° F. (56.5° C.), or propionaldehyde, having a boiling point of 120.2° F. (49° C.) are especially preferred. Other aldehydes, such as acetaldehyde or butyraldehyde can also be used with appropriate temperature and pressure adjustments, as can other ketones such as methyl ethyl ketone and diethyl ketone.

As oxidizing agent, it is preferred to use a peroxide, such as hydrogen peroxide or sodium peroxide. Organic peroxides such as tertiary butyl hydroperoxide, cyclohexanone peroxide, dicumyl peroxide, and the like can also be used, if desired. Hydrogen peroxide is an especially preferred oxidant and can be used in the form of an aqueous solution containing 10% to 60% hydrogen peroxide. Most preferred is 30% hydrogen peroxide.

For achieving basic conditions for the exothermic reaction to occur, a hydroxide is generally utilized. Sodium hydroxide or potassium hydroxide is preferred for this purpose. Other hydroxides which can be used include ammonium hydroxide and calcium hydroxide. Basic salts such as sodium carbonate can also be used, if desired.

The preferred order of mixing of reactants is to add the carbonyl compound to the coal or petroleum fraction, followed by adding a mixture of base and oxidizing agent. An exothermic reaction ensues and the volume of the reaction mixture expands to 5 to 15 times its original volume, while the temperature increases. When the process is conducted at ambient conditions, the temperature increases to about 130° F. to 150° F. During the reaction, a substantial amount of gaseous products is formed, which may be recovered. Following completion of the reaction, the carbonyl compound can be distilled from the reaction mixture and any water present can also be removed by distillation or by any other oil/water separation process.

Alternatively, the process can be conducted as a continuous process in which the reactants are introduced continuously and, if desired, heat is added to a reaction vessel. Temperatures in the range of about 120° F. to 250° F. are generally maintained in the reaction vessel during operation of such continuous process, The principal products of the reaction are a coal or hydrocarbon fraction containing less than about 1% sulfur and a mixture of gaseous products and salts including predominantly hydrogen sulfide, but also containing some sulfur dioxide, as well as other oxides of sulfur. If desired, the hydrogen sulfide can be utilized in a Claus process for conversion of the hydrogen sulfide content of the gaseous product to elemental sulfur.

In the following description of the process the carbonaceous material to be desulfurized will be exemplified as a petroleum fraction. It is to be understood, however, that the process is similarly applicable to coal or coal slurries as well as to other solid and liquid carbonaceous materials.

Turning now to the drawing, the numeral 10 represents a tank used for storing a petroleum fraction which is introduced into a mixing vessel 16 by means of a conduit 12 and a pump 14. Acetone is introduced into mixing vessel 16 from a storage tank 18 by means of a conduit 20 and a pump 22. A mixture of petroleum fraction and acetone from mixing vessel 16 is introduced into a pump mixer vessel 30 by means of conduits 24 and 26 and a pump 28. Sodium hydroxide from a storage tank 32 is introduced into a motionless mixer 40 by means of conduits 34 and 36 and a pump 38. Hydrogen peroxide from a storage tank 42 is introduced into motionless mixer 40 by means of conduits 34 and 44 and a pump 46. A mixture of sodium hydroxide and hydrogen peroxide from motionless mixer 40 is mixed with the mixture of petroleum fraction and acetone from mixing vessel 16 by means of conduit 48 and the mixture is introduced into pump mixer 30 by means of a conduit 24. The mixture of petroleum fraction, acetone, sodium hydroxide, and hydrogen peroxide is introduced into a reactor-separator 52 by means of a conduit 50. Following reaction, gases and low boiling point organic fractions including acetone and light oils are vaporized, exit reactor-separator 52, and are introduced into a reflux condenser 56 by means of a conduit 54. Condensed acetone as well as non-condensable sulfur gases are introduced into a knock-out pot 60 by means of a conduit 58. Non-condensable sulfur gases are flowed to a Claus plant by means of a conduit 62. Condensed acetone is removed by means of a conduit 64, recycled to reactor-separator 52 by means of a conduit 66, and recycled to mixing vessel 16 by means of a conduit 68. Light oil product is removed from reactor-separator 52 by means of a conduit 70, cooled in a light oil product cooler 72, and passed to storage by means of a conduit 74. Water and desulfurized higher boiling point oils descend to the bottom of reactor-separator 52, where they are removed by means of a conduit 76 and introduced into a crude product cooler 78. Cooled product is removed from crude product cooler 78 by means of a conduit 80 and separated from water and salt in an oil-water separator 82. Desulfurized crude product is removed from oil-water separator 82 by means of a conduit 84 and passed to storage. Water and salt are removed from oil-water separator 82 by means of a conduit 86 and passed to wastewater treatment. A steam heated reboiler 88 reheats a portion of the product stream from the bottom of reactor-separator 52 taken off by means of conduits 90 and 92.

The invention is exemplified as follows:

EXAMPLE 1

At a temperature of 72° F. and ambient pressure, 100 ml of No. 6 fuel oil was added to a 2000 ml beaker. The specific gravity of the fuel oil was just over 14 API and it had a boiling range of 300°–450° F. The fuel oil was identified as having an average of 3.4% sulfur content. The beaker was placed upon a stir plate with a stirring pellet in the fuel oil. A quantity of 15 ml of acetone was added and stirred at 20–30% plate control capacity. Ten pellets of sodium hydroxide were then dissolved in 20 ml of a 30% solution of hydrogen peroxide, and stirred into the beaker. The fuel oil began to oxidize, and the gas was collected from the top of the beaker. The volumetric change from oxidation was directly related to the rate of stirring. The stirring was increased until the volume had reached 10–15 times its original volume, and held there for the duration of the reaction. A slight negative pressure was applied at the top of the beaker to facilitate removal of the H2S, SO2, and any other gaseous sulfides formed in the reaction. The volumetric expansion subsided at the end of the reaction. The temperature had then risen to about 140° F. The acetone and any hydrocarbon fractions used as a cutting stock remaining after the reaction was completed were distilled off Following this temperature rise, the temperature was further increased to distill off any water. Average processing time was 32 minutes. The fuel oil was then sampled and tested for any sulfur content. At this time, any cutting stocks that had previously distilled off during the reaction may be added back to the fuel oil to maintain the original specific gravity and physical characteristics. The results are summarized in Table I.

EXAMPLE 2

At a temperature of 72° F. and ambient pressure, 100 ml of a Venezuela bitumen was added to a 2000 ml beaker. The specific gravity of the bitumen was just under 6 API and it had a boiling range of 400°–650° F. The bitumen was identified as having an average of 6.9% sulfur content. The beaker was placed upon a stir plate with a stirring pellet in the bitumen. A quantity of 30 ml of acetone was added and stirred at 20–30% plate control capacity. Fifteen pellets of sodium hydroxide were then dissolved in 25 ml of a 30% solution of hydrogen peroxide and stirred into the beaker. The bitumen began to oxidize, and the gas was collected from the top of the beaker. The volumetric change from oxidation was directly related to the rate of stirring. The stirring was increased until the volume had reached 10–15 times its original volume and held there for the duration of the reaction. A slight negative pressure was applied at the top of the beaker to facilitate removal of the H2S, SO2, and any other gaseous sulfides formed in the reaction. The volumetric expansion subsided at the end of the reaction. The temperature had then risen to about 140° F. The acetone and any hydrocarbon fractions used as a cutting stock remaining after the reaction was completed were distilled off Following this rise, the temperature was further increased to distill off any water. Average processing time was 41 minutes. The bitumen was then sampled and tested for any sulfur content. At this time, any cutting stocks that had previously distilled off during the reaction may be added back to the bitumen to maintain the original specific gravity and physical characteristics. The results are summarized in Table I.

EXAMPLE 3

At a temperature of 72° F. and ambient pressure, 50 ml of a bunker fuel were added to a 2000 ml beaker. The specific gravity of the bunker fuel was just over 7 API, and it had a boiling range of 350°–600° F. The bunker fuel was identified as having an average of 4.8% sulfur content. The beaker was placed upon a stir plate with a stirring pellet in the bunker fuel. A quantity of 10 ml of acetone was added and stirred at 20–30% plate control capacity. Fifteen pellets of sodium hydroxide were then dissolved in 15 ml of a 30% solution of hydrogen peroxide, and stirred into the beaker. The bunker fuel began to oxidize, and the gas was collected from the top of the beaker. The volumetric change from oxidation was directly related to the rate of stirring. The stirring was increased until the volume had reached 10–15 times its original volume and held there for the duration of the reaction. A slight negative pressure was applied at the top of the beaker to facilitate removal of the H2S, SO2, and any other gaseous sulfides formed in the reaction. The volumetric expansion subsided at the end of the reaction. The temperature of the fuel had then risen to about 140° F. The acetone and any hydrocarbon factions used as a cutting stock remaining after the reaction was completed were distilled off. Following this rise, the temperature was further increased to distill off any water. Average processing time was 36 minutes. The bunker fuel was then sampled and tested for any sulfur content. At this time any cutting stocks that had previously distilled off during the reaction may be added back to the bunker fuel to maintain the original specific gravity and physical characteristics. The results are summarized in Table I.

EXAMPLE 4

At a temperature of 72° F. and ambient pressure, 50 ml of an unidentified heavy crude provided by the Commonwealth Oil Refining Company was added to a 2000 ml beaker. The specific gravity of the crude oil was just over 14 API, and it had a 90% boiling range above 250° F. The crude oil was identified as having an average of 2.9% sulfur content. The beaker was placed upon a stir plate with a stirring pellet in the crude oil. A quantity of 10 ml of acetone was added and stirred at 20–30% plate control capacity. Fifteen pellets of sodium hydroxide were then dissolved in 15 ml of a 30% solution of hydrogen peroxide, and stirred into the beaker. The crude oil began to oxidize, and the gas was collected from the top of the beaker. The volumetric change from oxidation was directly related to the rate of stirring. The stirring was increased until the volume had reached 10–15 times its original volume and held there for the duration of the reaction. A slight negative pressure was applied at the top of the beaker to facilitate removal of the H2S, SO2, and any other gaseous sulfides formed in the reaction. The volumetric expansion subsided at the end of the reaction. The temperature had then risen to about 140° F. The acetone was distilled off. Following this temperature rise, the temperature was further increased to distill off any water. Average processing time as 27 minutes. The crude oil was then sampled and tested for any sulfur content. The results are summarized in Table I.

TABLE I

| Operation | No. 6 Fuel Oil | Venezuela Bitumen | Bunker Fuel | Heavy Crude |
|---|---|---|---|---|
| Average Sulfur Content, % | 3.4 | 6.9 | 4.8 | 2.9 |
| Volume of hydrocarbon fraction, ml | 100 | 100 | 50 | 50 |
| Volume of acetone added, ml | 15 | 30 | 10 | 10 |
| Number of pellets of sodium hydroxide | 10 | 15 | 15 | 15 |
| Volume of 30% hydrogen peroxide, ml | 20 | 25 | 15 | 15 |
| Average reaction processing time, min | 32 | 41 | 36 | 27 |
| Average sulfur content after | 0.3 | 0.9 | 0.7 | 0.1 |

TABLE I-continued

| Operation | No. 6 Fuel Oil | Venezuela Bitumen | Bunker Fuel | Heavy Crude |
|---|---|---|---|---|
| processing % | | | | |
| Decrease in sulfur content, % | 91.18 | 86.96 | 85.42 | 96.55 |

Coal can be treated by using the reactants in similar order. In addition, it is anticipated that the invention can be used in combination with other physical coal cleaning processes including but not limited to coal washing. Because the initial reactant is water soluble, water may be used to lessen the reactant costs in reducing sulfur from coal.

The foregoing detailed description is to be clearly understood as given by way of illustration and example only, the spirit and scope of this invention being limited solely by the appended claims.

What is claimed is:

1. A process for desulfurizing sulfur-containing carbonaceous materials which comprises reacting a sulfur-containing carbonaceous material wherein sulfur is present in the form of sulfur-containing organic compounds with a mixture of an oxidizing agent, a carbonyl compound, and a hydroxide to produce a desulfurized carbonaceous product in which the sulfur content is less that about 1% by weight.

2. The process of claim 1 wherein said carbonaceous material is a petroleum fraction.

3. The process of claim 1 wherein said carbonaceous material is coal.

4. The process of claim 1 wherein said oxidizing agent is a peroxide.

5. The process of claim 4 wherein said peroxide is hydrogen peroxide.

6. The process of claim 1 wherein said carbonyl compound is a ketone.

7. The process of claim 6 wherein said ketone is acetone.

8. The process of claim 1 wherein said hydroxide is an alkali metal hydroxide.

9. The process of claim 1 wherein the sulfur content of said sulfur-containing carbonaceous material has been reduced by about 85% to 95%.

10. The process of claim 1, wherein besides said desulfurized carbonaceous product, gaseous sulfur compounds and salts are produced.

11. The process of claim 10 wherein said gaseous sulfur compounds comprise hydrogen sulfide.

12. The process of claim 10 wherein said gaseous sulfur compounds comprise sulfur dioxide.

13. A process for desulfurizing a carbonaceous material which comprises:

reacting a sulfur-containing carbonaceous material with a mixture of an oxidizing agent, a carbonyl compound, and a hydroxide at a temperature in the range of ambient temperature to about 250° F. and a pressure of about 1 atmosphere to 2 atmospheres; and producing a desulfurized carbonaceous product in which the sulfur content is less than about 1% by weight.

14. The process of claim 13 wherein said carbonaceous material is a petroleum fraction having a boiling point within the range of about 250° F. to 700° F.

15. The process of claim 13 wherein said carbonaceous material is coal.

16. The process of claim 13 wherein said oxidizing agent is a peroxide.

17. The process of claim 16 wherein said peroxide is hydrogen peroxide.

18. The process of claim 13 wherein said carbonyl compound is a ketone.

19. The process of claim 18 wherein said ketone is acetone.

20. The process of claim 13 wherein said hydroxide is an alkali metal hydroxide.

21. The process of claim 13 wherein the sulfur content of said sulfur-containing carbonaceous material has been reduced by about 85% to 95%.

22. The process of claim 13 wherein besides said desulfurized carbonaceous product, gaseous sulfur compounds and salts are produced.

23. The process of claim 22 wherein said gaseous sulfur compounds comprise hydrogen sulfide.

24. The process of claim 22 wherein said gaseous sulfur compounds comprise sulfur dioxide.

25. The process of claim 13 wherein the reaction temperature is about 120° F. to 250° F.

26. The process of claim 13 wherein the reaction temperature is ambient temperature and, during said reacting step the temperature rises to about 130° F. to 150° F. and the volume of the reaction mixture expands to about 5–15 times its original volume.

27. The process of claim 13 wherein the reaction temperature is maintained at about 200° F. to 250° F.

28. The process of claim 13 wherein said carbonyl compound is recovered.

29. A continuous process for desulfurizing a carbonaceous material which comprises:

introducing a sulfur-containing carbonaceous material, an oxidizing agent, a carbonyl compound, and a base into a reaction zone maintained at a temperature of about 200° F. to 250° F. and a pressure of about 1 atmosphere to 2 atmospheres;

reacting said sulfur-containing carbonaceous material with said oxidizing agent, said carbonyl compound, and said base in said reaction zone to produce a desulfurized carbonaceous product, in which the sulfur content is less than about 1% by weight, and a mixture of gaseous sulfur compounds comprising hydrogen sulfide and salts;

recovering said desulfurized carbonaceous product and said hydrogen sulfide; and recycling said carbonyl compound.

30. The process of claim 29 wherein said oxidizing agent is hydrogen peroxide, said carbonyl compound is acetone, and said base is an alkali metal hydroxide.

31. The process of claim 29 wherein the sulfur content of said sulfur-containing carbonaceous material has been reduced by about 85% to 95%.

* * * * *

US005961820C1

(12) EX PARTE REEXAMINATION CERTIFICATE (5126th)

United States Patent

Jeanblanc et al.

(10) Number: US 5,961,820 C1

(45) Certificate Issued: Jun. 28, 2005

(54) DESULFURIZATION PROCESS UTILIZING AN OXIDIZING AGENT, CARBONYL COMPOUND, AND HYDROXIDE

(75) Inventors: James K. Jeanblanc, Galva, IL (US); William E. Wismann, Oxnard, CA (US)

(73) Assignee: DS2 Tech, Inc., Galva, IL (US)

Reexamination Request:
No. 90/006,560, Mar. 10, 2003

Reexamination Certificate for:

| | |
|---|---|
| Patent No.: | **5,961,820** |
| Issued: | **Oct. 5, 1999** |
| Appl. No.: | **09/085,478** |
| Filed: | **May 27, 1998** |

(51) Int. Cl.[7] ..... C10G 27/00; C10G 29/00; C10G 27/06; C10G 29/02

(52) U.S. Cl. ..... 208/231; 208/226; 208/240; 208/208 R; 208/196; 208/189; 208/203

(58) Field of Search ..... 208/231, 226, 208/240, 208 R, 196, 189, 203

(56) References Cited

U.S. PATENT DOCUMENTS 3,964,994 A 6/1976 Kelly

*Primary Examiner*—Thuan D. Dang

(57) ABSTRACT

Sulfur-containing carbonaceous materials are desulfurized by reaction with a mixture of an oxidizing agent and a carbonyl compound under alkaline conditions at a temperature ranging from ambient temperature to about 250° F. and a pressure of about 1 atmosphere to 2 atmospheres. The products of the reaction are a desulfurized carbonaceous material in which the sulfur content is less than about 1%, and gaseous sulfur compounds. The carbonyl compound can be recovered and reused.

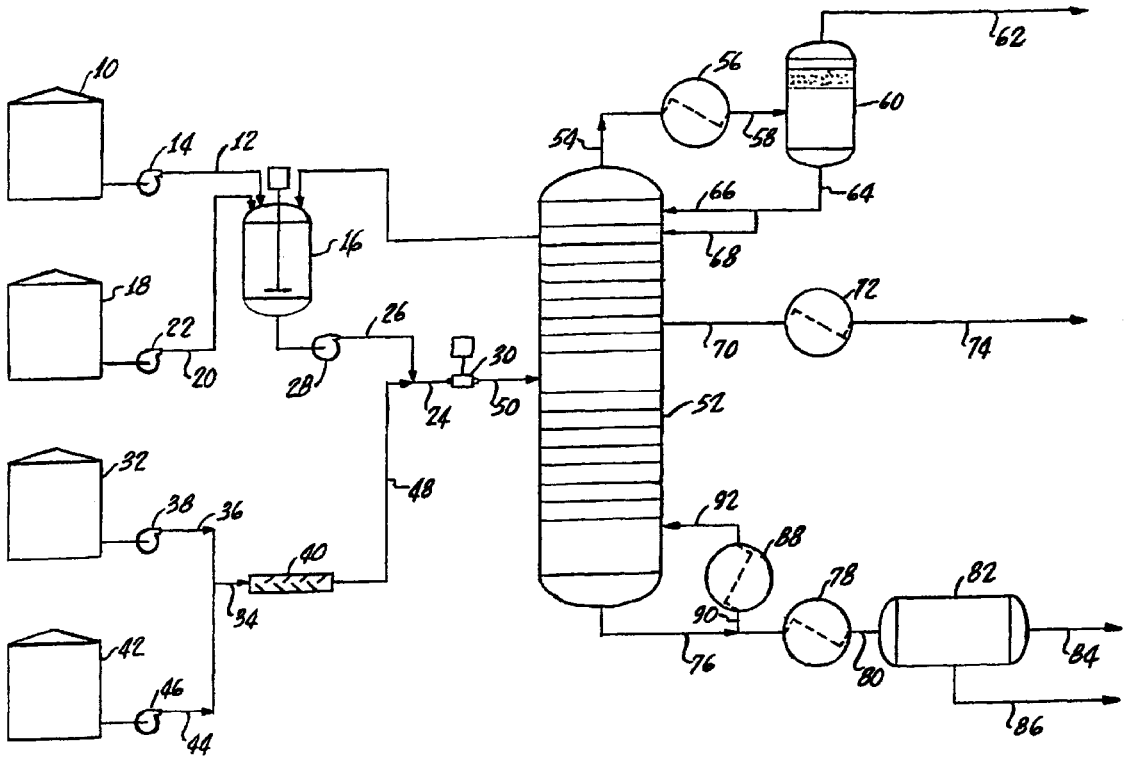

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 13 and 29 are determined to be patentable as amended.

Claims 2–12, 14–28, 30 and 31, dependent on an amended claim, are determined to be patentable.

1. A process for desulfurizing sulfur-containing carbonaceous materials which comprises reacting a sulfur-containing carbonaceous material wherein sulfur is present in the form of sulfur-containing organic compounds with a mixture of an oxidizing agent, a carbonyl compound, and a hydroxide to produce a desulfurized carbonaceous product in which the sulfur content is less [that] *than* about 1% by weight*, and wherein said reaction occurs in the absence of a catalyst*.

13. A process for desulfurizing a carbonaceous material which comprises:

reacting a sulfur-containing carbonaceous material with a mixture of an oxidizing agent, a carbonyl compound, and a hydroxide at a temperature in the range of ambient temperature to about 250° F. and a pressure of about 1 atmosphere to 2 atmospheres; and producing a desulfurized carbonaceous product in which the sulfur content is less than about 1% by weight*, and wherein said reaction occurs in the absence of a catalyst*.

29. A continuous process for desulfurizing a carbonaceous material which comprises:

introducing a sulfur-containing carbonaceous material, an oxidizing agent, a carbonyl compound, and a base into a reaction zone maintained at a temperature of about 200° F. to 250° F. and a pressure of about 1 atmosphere to 2 atmospheres;

reacting said sulfur-containing carbonaceous material with said oxidizing agent, said carbonyl compound, and said base in said reaction zone to produce a desulfurized carbonaceous product, in which the sulfur content is less than about 1% by weight, and a mixture of gaseous sulfur compounds comprising hydrogen sulfide and salts;

recovering said desulfurized carbonaceous product and said hydrogen sulfide; [and]

recycling said carbonyl compound*; and*

*wherein said reaction occurs in the absence of a catalyst*.

* * * * *